US007908678B2

(12) United States Patent
Brine, III et al.

(10) Patent No.: US 7,908,678 B2
(45) Date of Patent: Mar. 22, 2011

(54) SPORT HELMET WITH ADJUSTABLE LINER

(76) Inventors: William H. Brine, III, Hopkinton, MA (US); Eric Darnell, South Stafford, VT (US); Jonathan Baker, Portland, OR (US); William H. Brine, IV, Hopkinton, MA (US)

( * ) Notice: Subject to any disclaimer, the term of this patent is extended or adjusted under 35 U.S.C. 154(b) by 1025 days.

(21) Appl. No.: 11/644,085

(22) Filed: Dec. 22, 2006

(65) Prior Publication Data

US 2007/0199136 A1 Aug. 30, 2007

Related U.S. Application Data

(60) Provisional application No. 60/753,100, filed on Dec. 22, 2005.

(51) Int. Cl.
*A42B 1/22* (2006.01)

(52) U.S. Cl. ..... 2/417; 2/410; 2/425

(58) Field of Classification Search ..... 2/6.1, 183, 2/410, 411, 412, 413, 417, 418, 421, 425, 2/420

See application file for complete search history.

(56) References Cited

U.S. PATENT DOCUMENTS

| | | | | | |
|---|---|---|---|---|---|
| 2,763,005 | A * | 9/1956 | Richter | 2/414 |
| 3,025,525 | A * | 3/1962 | Larson | 2/419 |
| 3,028,602 | A * | 4/1962 | Miller | 2/6.1 |
| 3,579,637 | A * | 5/1971 | Aileo | 2/418 |
| 3,696,440 | A * | 10/1972 | Littleton | 2/418 |
| 3,820,163 | A * | 6/1974 | Rappleyea | 2/420 |
| 3,950,483 | A * | 4/1976 | Spier | 264/241 |
| 4,282,610 | A * | 8/1981 | Steigerwald et al. | 2/414 |
| 4,404,690 | A * | 9/1983 | Farquharson | 2/420 |
| 4,412,358 | A * | 11/1983 | Lavender | 2/412 |
| 4,586,200 | A * | 5/1986 | Poon | 2/413 |
| 4,713,844 | A * | 12/1987 | Westgate | 2/411 |
| 4,827,537 | A * | 5/1989 | Villa | 2/410 |
| 5,042,093 | A * | 8/1991 | Legendre | 2/419 |
| 5,083,320 | A * | 1/1992 | Halstead | 2/413 |
| 5,381,560 | A * | 1/1995 | Halstead | 2/421 |
| 5,511,250 | A * | 4/1996 | Field et al. | 2/418 |
| 5,659,900 | A * | 8/1997 | Arney et al. | 2/417 |
| 5,815,847 | A * | 10/1998 | Holden, Jr. | 2/418 |
| 5,898,950 | A * | 5/1999 | Spyrou et al. | 2/421 |
| 5,913,412 | A * | 6/1999 | Huber et al. | 2/414 |
| 5,915,537 | A * | 6/1999 | Dallas et al. | 2/410 |
| 5,953,761 | A * | 9/1999 | Jurga et al. | 2/425 |
| 6,240,571 | B1 * | 6/2001 | Infusino | 2/414 |
| 6,298,497 | B1 * | 10/2001 | Chartrand | 2/414 |
| 6,385,780 | B1 * | 5/2002 | Racine | 2/414 |
| 6,865,752 | B2 * | 3/2005 | Udelhofen et al. | 2/425 |
| 6,968,575 | B2 * | 11/2005 | Durocher | 2/425 |
| 6,981,284 | B2 * | 1/2006 | Durocher | 2/425 |
| 7,634,820 | B2 * | 12/2009 | Rogers et al. | 2/417 |
| 2003/0135914 | A1 * | 7/2003 | Racine et al. | 2/413 |
| 2009/0151056 | A1 * | 6/2009 | Desjardins et al. | 2/413 |

* cited by examiner

*Primary Examiner* — Katherine Moran
*Assistant Examiner* — Richale L Quinn
(74) *Attorney, Agent, or Firm* — H. Jay Spiegel

(57) ABSTRACT

A protective sport helmet having an interior liner capable of conforming to the head of the wearer in the fore and aft direction and/or the side-to-side direction is disclosed. The sport helmet can comprise a protective outer shell and an inner energy-absorbing liner. The liner can comprise a top portion and a base portion flexibly connected therebetween to adjust the fit of the helmet to the head of a wearer in the fore and aft direction. The liner can comprise a side liner portion and the outer shell can comprise a slider mechanism for engaging the side liner portion to adjust the fit of the helmet to the head of the wearer in the side-to-side direction. The liner can comprise a plurality of grooves to transfer energy across the liner material.

14 Claims, 20 Drawing Sheets

SPORT HELMET WITH ADJUSTABLE LINER

CROSS REFERENCE TO RELATED APPLICATION

This application claims the benefit of U.S. Provisional Patent Application Ser. No. 60/753,100 filed Dec. 22, 2005, which is incorporated herein by reference.

FIELD OF THE INVENTION

The present invention relates generally to protective sport helmets, and more particularly relates to protective sport helmets having interior liners that are adjustable to conform to the head of the wearer.

BACKGROUND INFORMATION

Protective helmets for use in a variety of different sporting events, as well as a variety of recreational activities, are well known. Helmets used by those engaged in certain sports, such as lacrosse, typically comprise a hard outer shell that surrounds a liner of energy-absorbing material. The hard outer shell of most protective helmets is typically comprised of a relatively rigid plastic material. The outer shell typically covers the protective liner that lies between the outer shell and the wearer's head. When manufactured, helmets are typically assembled by inserting a pre-sized protective liner within a pre-sized outer shell. Although a standard helmet can approximately accommodate most wearers, natural variation in head sizes and head dimensions can cause the same helmet to fit differently on different wearers. This is particularly true, for example, of youth wearers. As children and adolescents develop at different rates, head size and head dimensions vary widely among youths of the same age group. Accordingly, a standard helmet size may approximately accommodate some youths better than others.

One of the primary purposes of a helmet is to reduce the risk of injury to the wearer's head from forces directed to the head. In order to enhance the performance of a protective helmet, the helmet should conform securely to the wearer's head in all directions. When a helmet is not properly secured and can slip with respect to the wearer's head in the vertical direction, the fore and aft direction, or the side-to-side direction, an increased risk of injury can exist.

Many protective helmets include a chinstrap, which can be restrained around the chin of the wearer to secure the helmet against the top of the head. Although effective in conforming the helmet to the head of the wearer in the vertical direction, a chinstrap does not effectively secure a helmet to the head of the wearer in the fore and aft directions or side-to-side directions. The chinstraps commonly used to secure the helmet in proper position are often difficult to adjust, resulting in the helmet being improperly positioned, thus providing limited protection to the wearer.

Accordingly, a need remains for a protective sport helmet that can be adjusted to conform to the head size and head dimensions of the wearer in the fore and aft direction and the side-to-side direction, as well as in the vertical direction.

SUMMARY OF THE INVENTION

The present invention is directed to a protective sport helmet having an interior liner capable of conforming to the head of the wearer in the fore and aft direction and/or the side-to-side direction. The sport helmet can comprise a protective outer shell and an inner energy-absorbing liner. The liner can comprise a top portion and an anterior portion flexibly connected therebetween to adjust the fit of the helmet to the head of a wearer in the fore and aft direction. The liner can comprise a side liner portion and the outer shell can comprise a slider mechanism for engaging the side liner portion to adjust the fit of the helmet to the head of the wearer in the side-to-side direction. The liner can comprise a plurality of grooves to transfer energy across the liner material.

An aspect of the present invention is to provide a protective sport helmet comprising a protective outer shell and a liner insert disposed within the protective outer shell. The liner insert has a top liner portion and at least one adjustable liner portion flexibly connected to the top portion and movable from an expanded position adjacent to an inner surface of the protective outer shell to a contracted position away from the inner surface of the protective shell.

Another aspect of the present invention is to provide a protective sport helmet comprising a protective outer shell and a liner insert disposed within the protective outer shell. The liner insert has a top liner portion and an anterior liner portion flexibly connected to the top portion and movable from a first position adjacent to an inner surface of the protective outer shell to a second position away from the inner surface of the protective shell.

A further aspect of the present invention is to provide a protective sport helmet comprising a protective outer shell, at least one slide member slidably mounted on a side of the protective outer shell, and a liner insert disposed within the protective outer shell. The liner insert includes at least one side liner portion having a surface contacting the sliding member, wherein movement of the at least one slide member causes movement of the at least one side liner portion toward or away from an inner surface of the protective outer shell.

Another aspect of the present invention is to provide a protective sport helmet, comprising a protective outer shell and a liner insert disposed within the protective outer shell, the liner insert comprising a plurality of grooves extending longitudinally along substantially the entire length of the liner insert between the liner insert and the protective outer shell.

These and other aspects of the present invention will be more fully understood following a review of this specification and drawings.

DETAILED DESCRIPTION

The present invention is directed to protective sports helmets, such as the protective sport helmet 30 shown in FIGS. 1-4. As used herein, the term "sport helmet" refers to protective helmets used in various types of sporting and recreational activities. For example, the protective sport helmet may be a lacrosse helmet, field hockey helmet, football helmet, hockey helmet or the like. While a protective lacrosse helmet 30 is shown in the figures and primarily described herein, it is understood that other types of sports helmets are within the scope of the present invention.

The protective helmet 30 shown in the embodiment of FIGS. 1-16 comprises a protective outer shell 32, an inner energy-absorbing liner 34 disposed within the protective outer shell, and a face grill 36 fastened to the outer shell 32. The protective outer shell 32 may be made of known types of relatively rigid plastic material, and is typically provided as unitary piece of material. The energy-absorbing liner 34 can comprise any conventionally known helmet liner material, such as resilient polymeric foam materials or any structure used to absorb impact such honeycombed plastic material or an air bladder.

Figure 1:
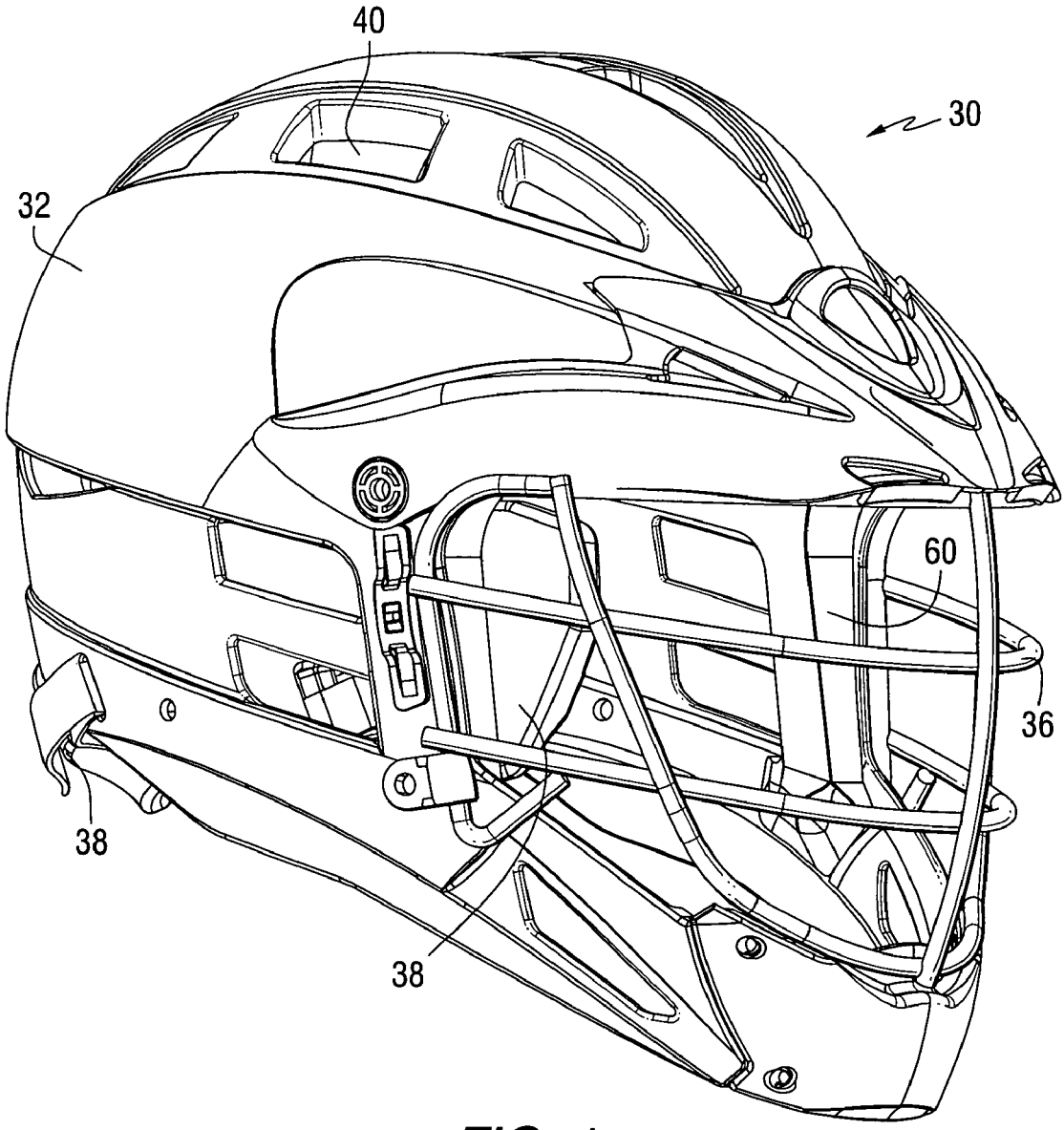
FIG. 1 is an isometric view of a protective helmet with an adjustable liner in accordance with an embodiment of the present invention.
Figure 2:
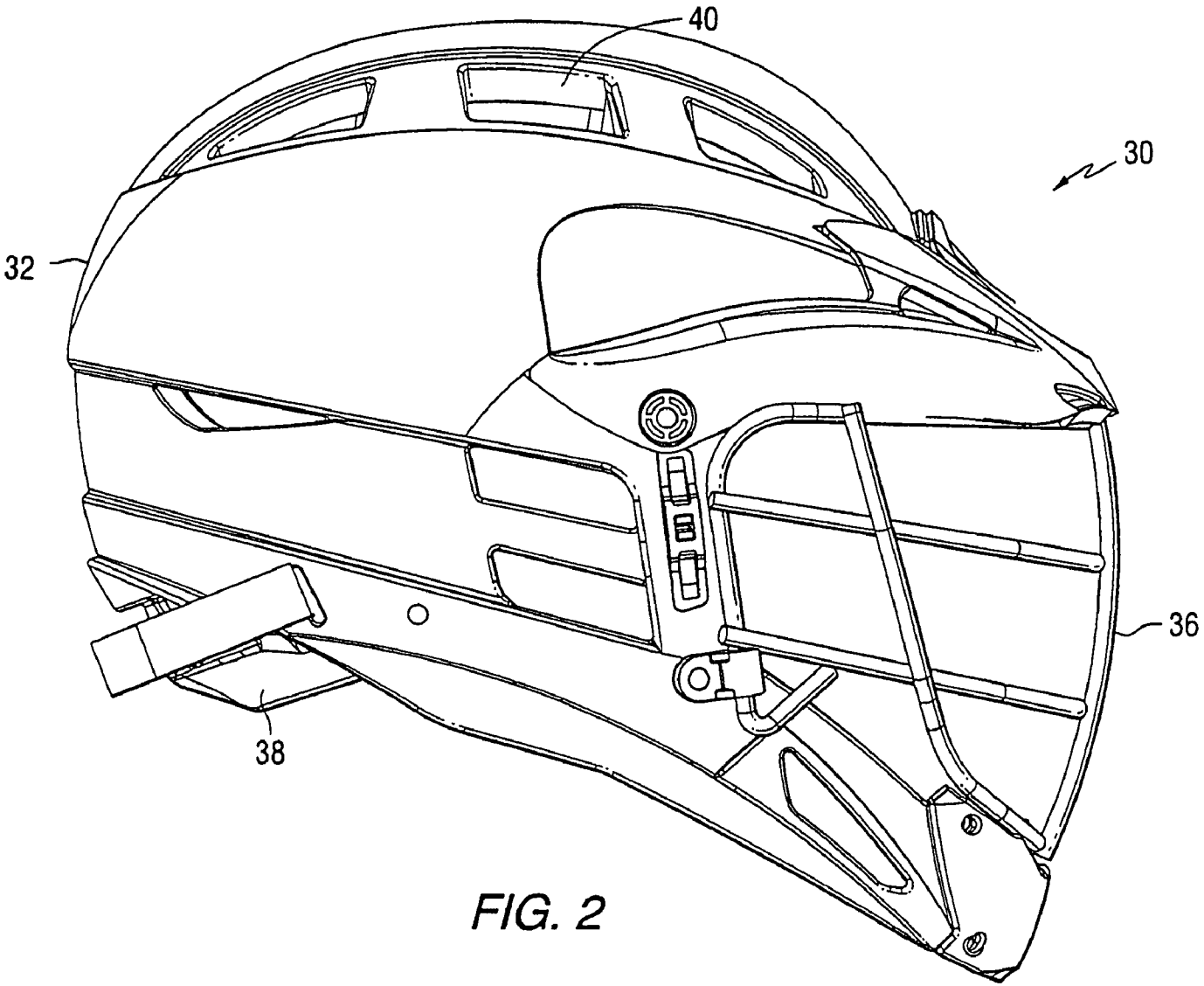
FIG. 2 is a side view of the protective helmet of FIG. 1.
Figure 3:
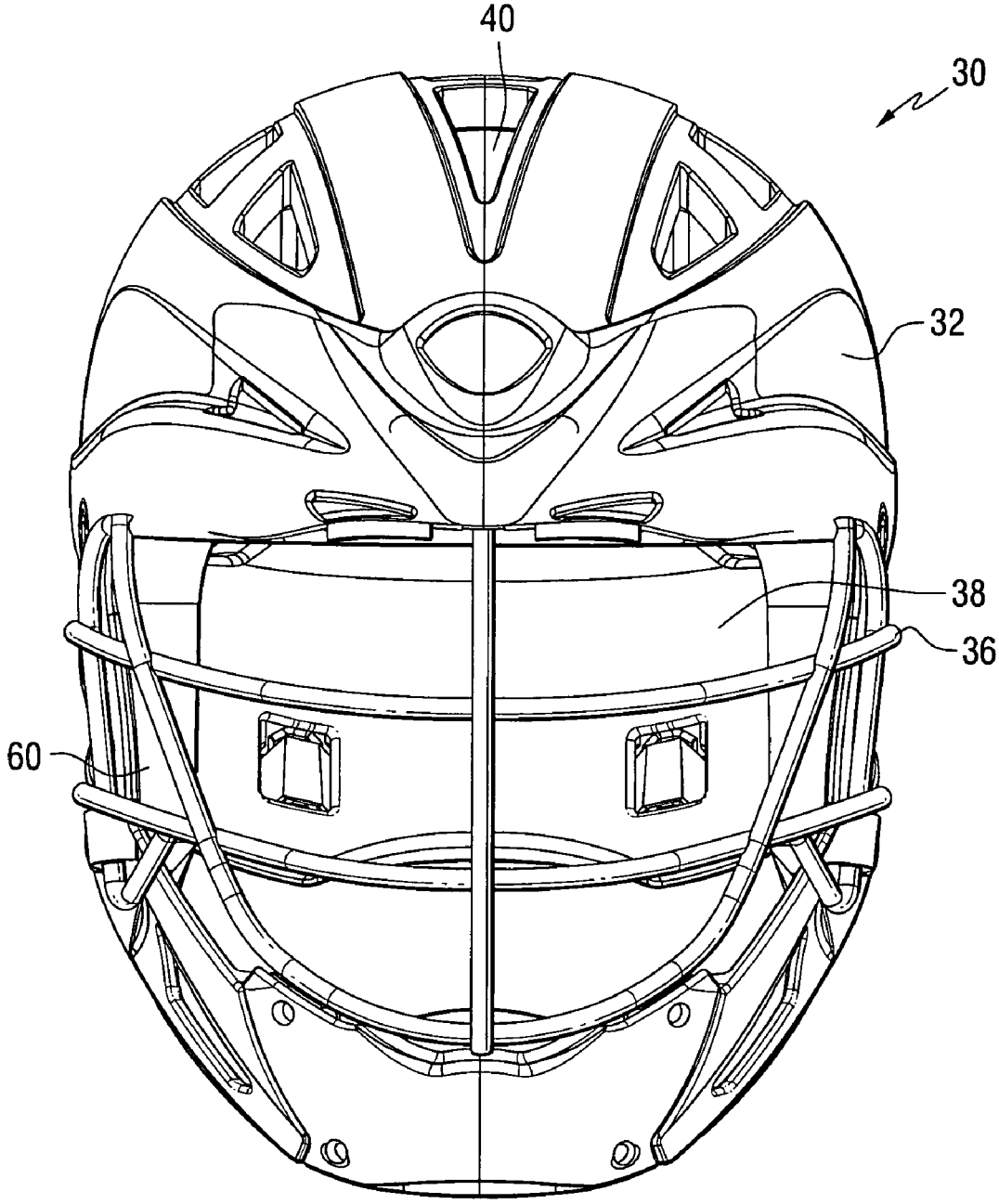
FIG. 3 is a front view of the protective helmet of FIG. 1.
Figure 4:
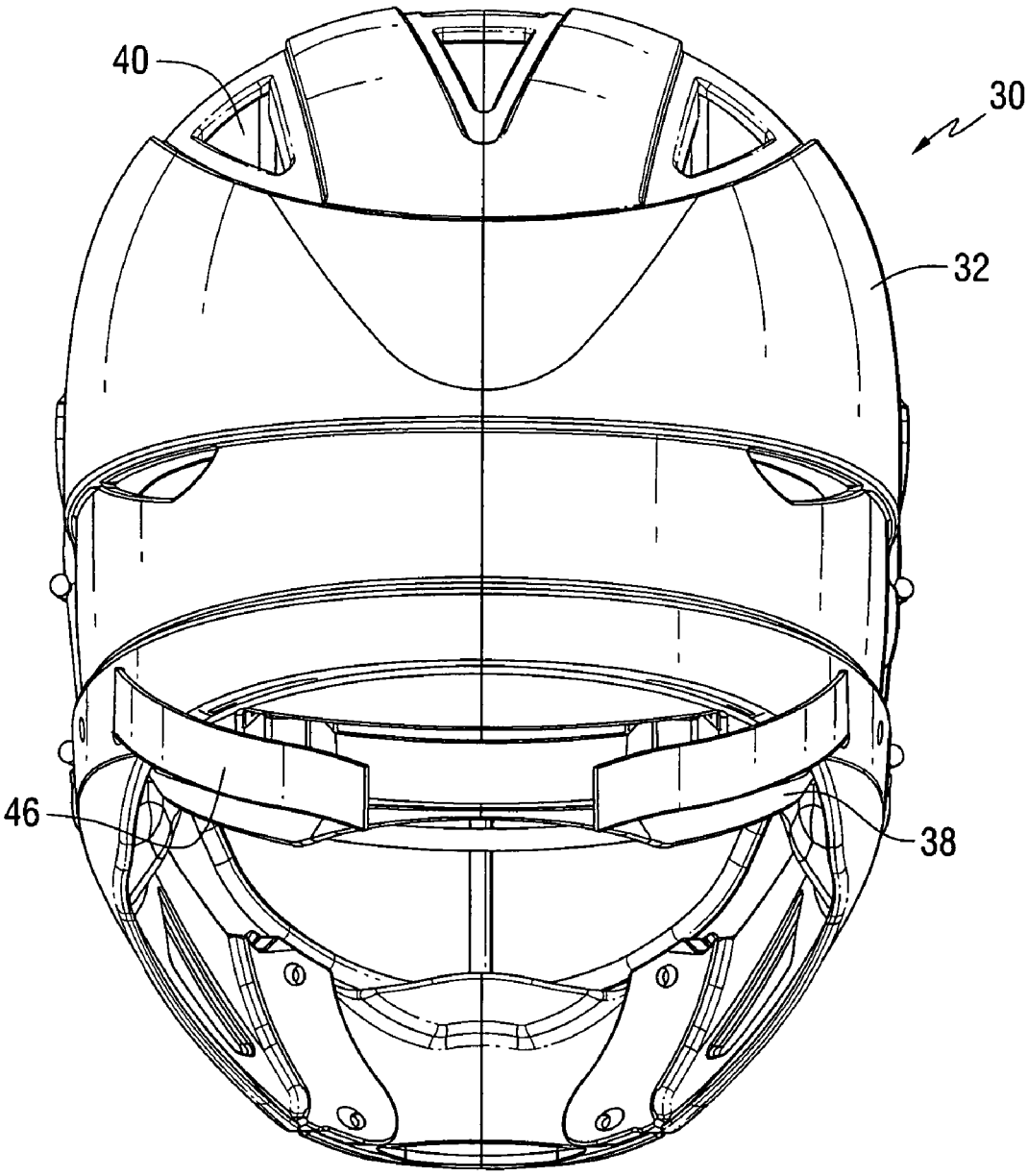
FIG. 4 is a rear view of the protective helmet of FIG. 1.
Figure 5:
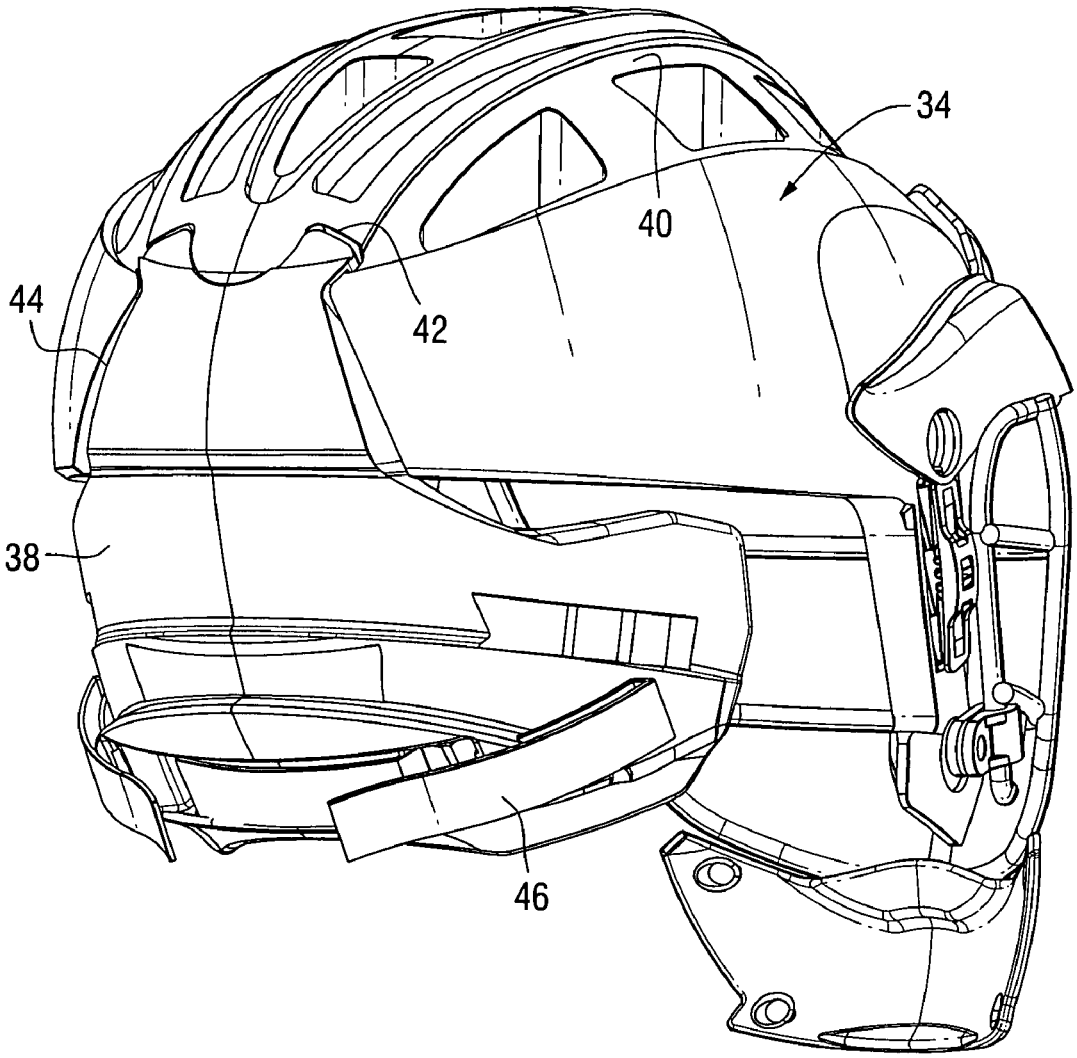
FIG. 5 is an isometric view of a protective helmet liner with the outer shell removed in accordance with an embodiment of the present invention.
Figure 6:
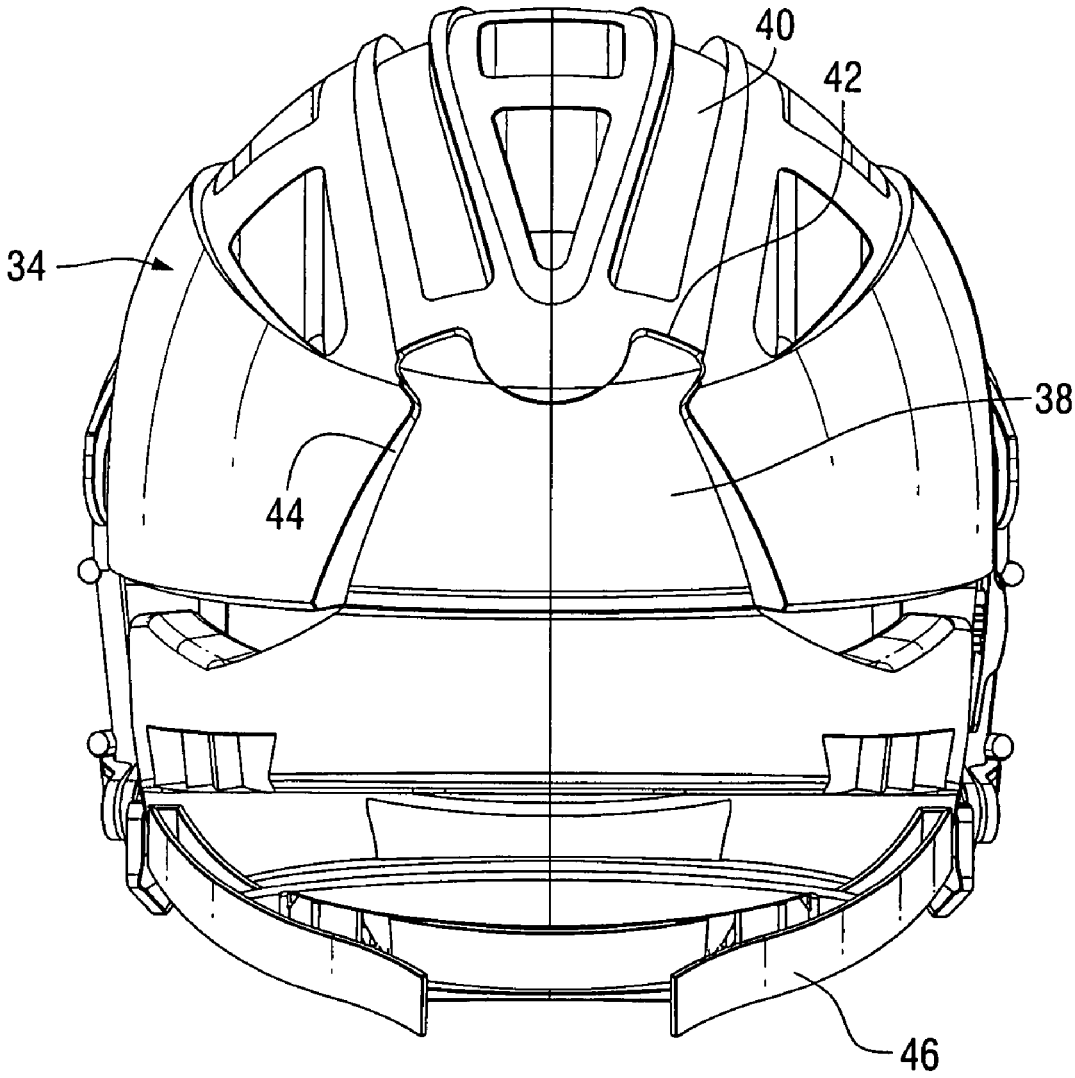
FIG. 6 is a rear view of the protective helmet liner of FIG. 5.

As shown in FIGS. 5 and 6, the liner 34 of the helmet 30 comprises a plurality of liner sections. In one embodiment, the liner 34 comprises an anterior liner portion 38 and a top liner portion 40 which are flexibly attached to each other. Top liner portion 40 can comprise any suitable shape and dimensions such that it substantially surrounds the upper portion of the skull of a wearer, including the parietal region of the head. Anterior liner portion 38 can also comprise any suitable shape and dimensions such that it is disposed at least partially about the back of the skull, such as at least partially disposed about the occipital and temporal regions of the head.

The top liner portion 40 and the anterior liner portion 38 are flexibly connected. Such flexible attachment may be provided by a pivoting connection between separate pieces 38 and 40 as shown in the figures. Alternately, the flexible attachment may be provided by the use of flexible material between the base 38 and top 40 liner portions, e.g., a unitary liner with sufficient flex between the base and top portions. Thus, the top liner portion 40 and the anterior liner portion 38 can be joined by an engagement mechanism or can comprise a unitary piece or portions that are shaped to flexibly engage one another. As shown in the embodiment of FIGS. 5 and 6, the top liner portion 40 can comprise a contoured dovetail portion 42 and the anterior liner portion 38 can comprise a contoured dovetail portion 44 that flexibly mates with the contoured dovetail portion 42 of the top liner portion to allow the anterior liner portion 38 to pivot with respect to the top liner portion 40.

Once the helmet 30 is placed on the head of a wearer, the fit of the helmet 30 can be tightened or loosened by adjusting the fore and aft position of the anterior liner 38. The anterior liner portion 38 can pivot in a substantially perpendicular orientation to the plane of the top liner portion 40 to accommodate the shape of the head of the wearer. In one embodiment, the anterior liner portion 38 can pivot with respect to the top liner portion 40 from about 1 to about 20 degrees, for example, from about 5 to about 10 degrees. This configuration allows a single size helmet liner 34 and protective outer shell 32 to accommodate many head sizes and shapes by providing a customized fit in the fore and aft direction.

Figure 7:
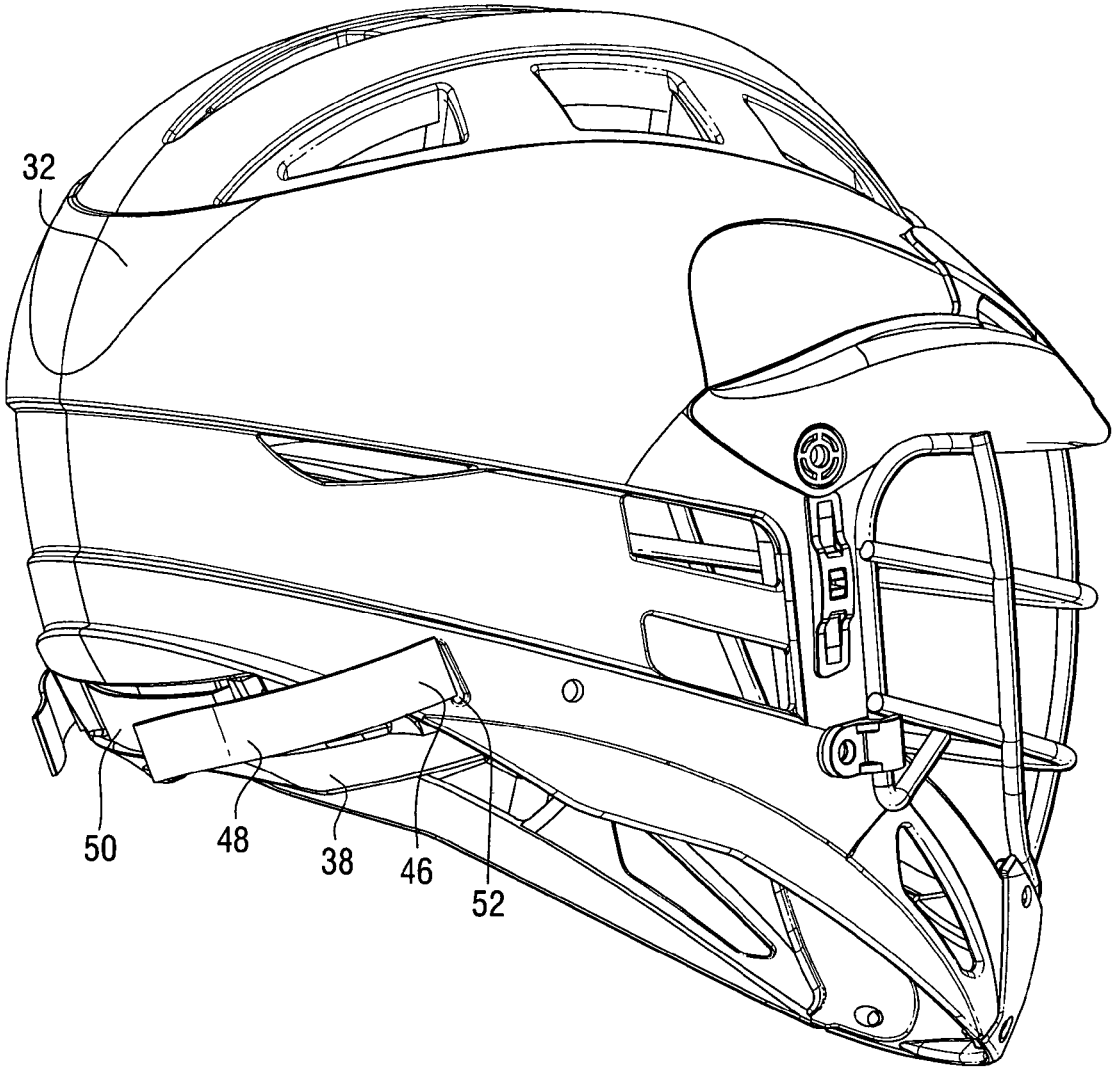
FIG. 7 is a rear side view of a protective helmet including an adjustable anterior liner portion positioned against the outer shell of the helmet in accordance with an embodiment of the present invention.
Figure 8:
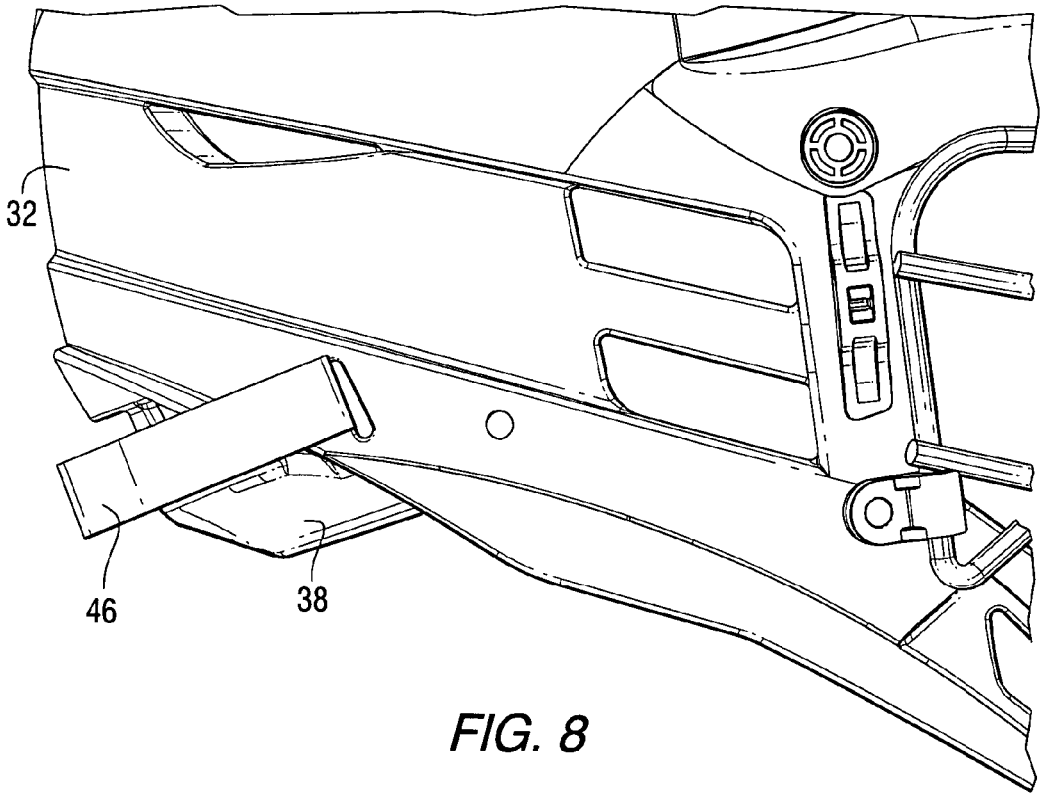
FIG. 8 is a side view of a portion of the helmet of FIG. 7.
Figure 9:
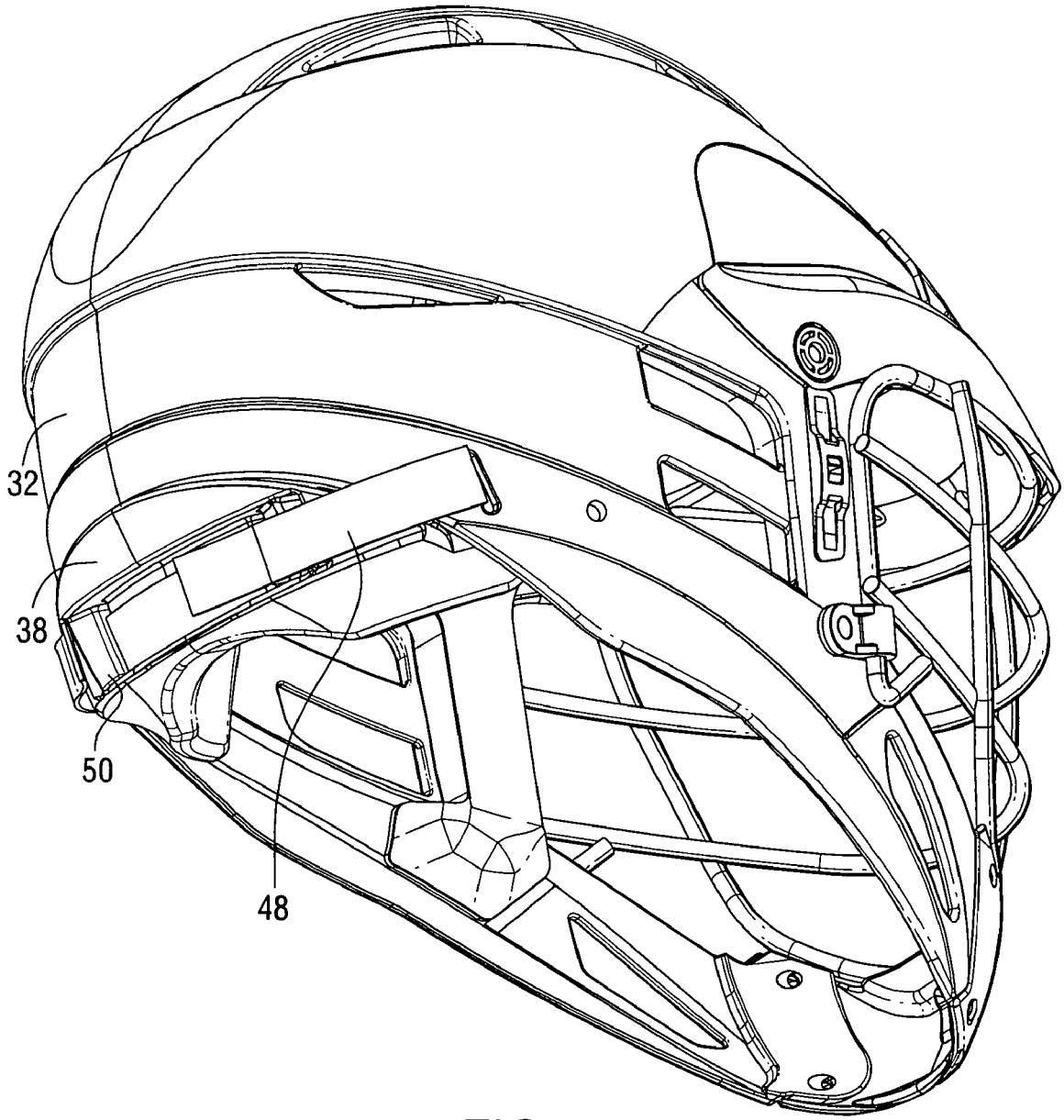
FIG. 9 is a rear side view of a protective helmet including an adjustable anterior liner portion moved inwardly away from the outer shell of the helmet in accordance with an embodiment of the invention.
Figure 10:
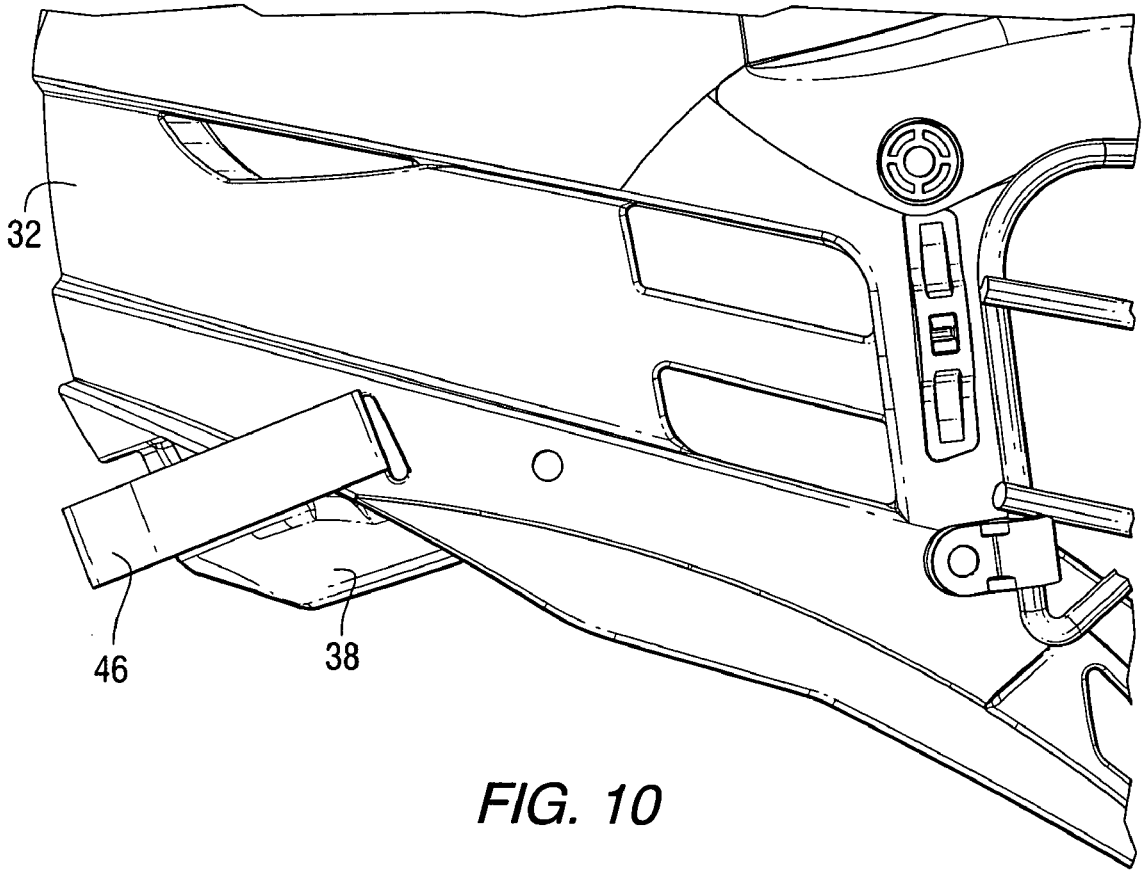
FIG. 10 is a side view of a portion of the protective helmet of FIG. 9.
Figure 11:
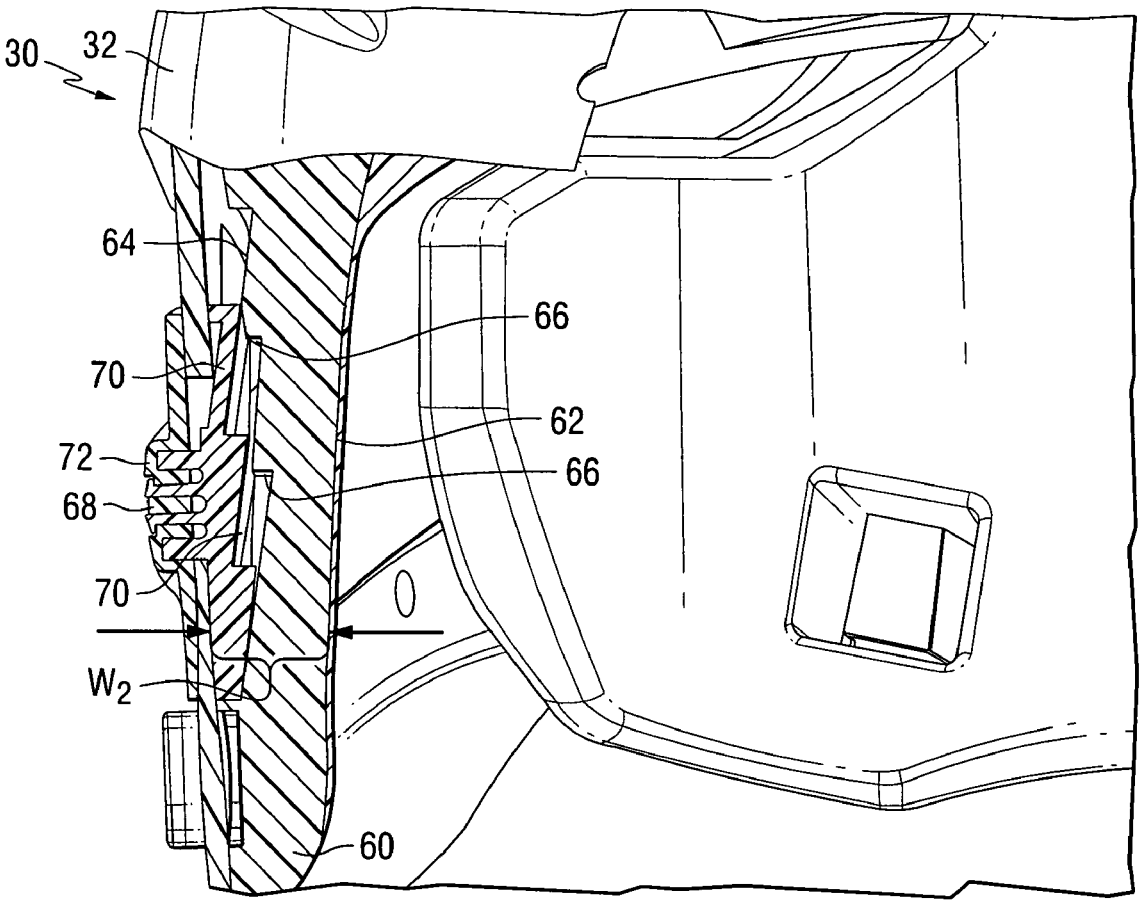
FIG. 11 is a sectional view through a side portion of a protective helmet showing an adjustable side portion of a liner and a slider mounted on an outer shell of the helmet for moving the side portion of the liner inwardly and outwardly in accordance with an embodiment of the present invention.

As shown in FIGS. 4-10, a securing mechanism 46, such as a securing strap, can be disposed within the protective outer shell 32 and positioned to engage the anterior liner portion 38 to secure the anterior liner portion 38 at a desired location around the head of a wearer. As shown in FIGS. 7 and 8, the anterior liner portion 38 can be positioned outward against an interior surface of the protective outer shell 32 in the unengaged position. As shown in FIGS. 9 and 10, the anterior liner portion 38 can be secured against the head of a wearer and drawn within the protective outer shell 32 in the engaged position.

As shown in FIG. 7, in the unengaged position, the securing mechanism 46 can comprise a strap 48 having one of hook and loop closure means and a tab 50 of the other of hook and loop closing means for securably mating therewith. In one embodiment, the tab 50 can be disposed on the anterior liner portion 38 and the strap 48 can be disposed through a slot 52 within the outer shell 32. As shown in FIGS. 9 and 10, in the engaged position, the strap 48 can be secured to the tab 50 and the anterior liner portion 38 can be secured against the head of a wearer.

Figure 12:
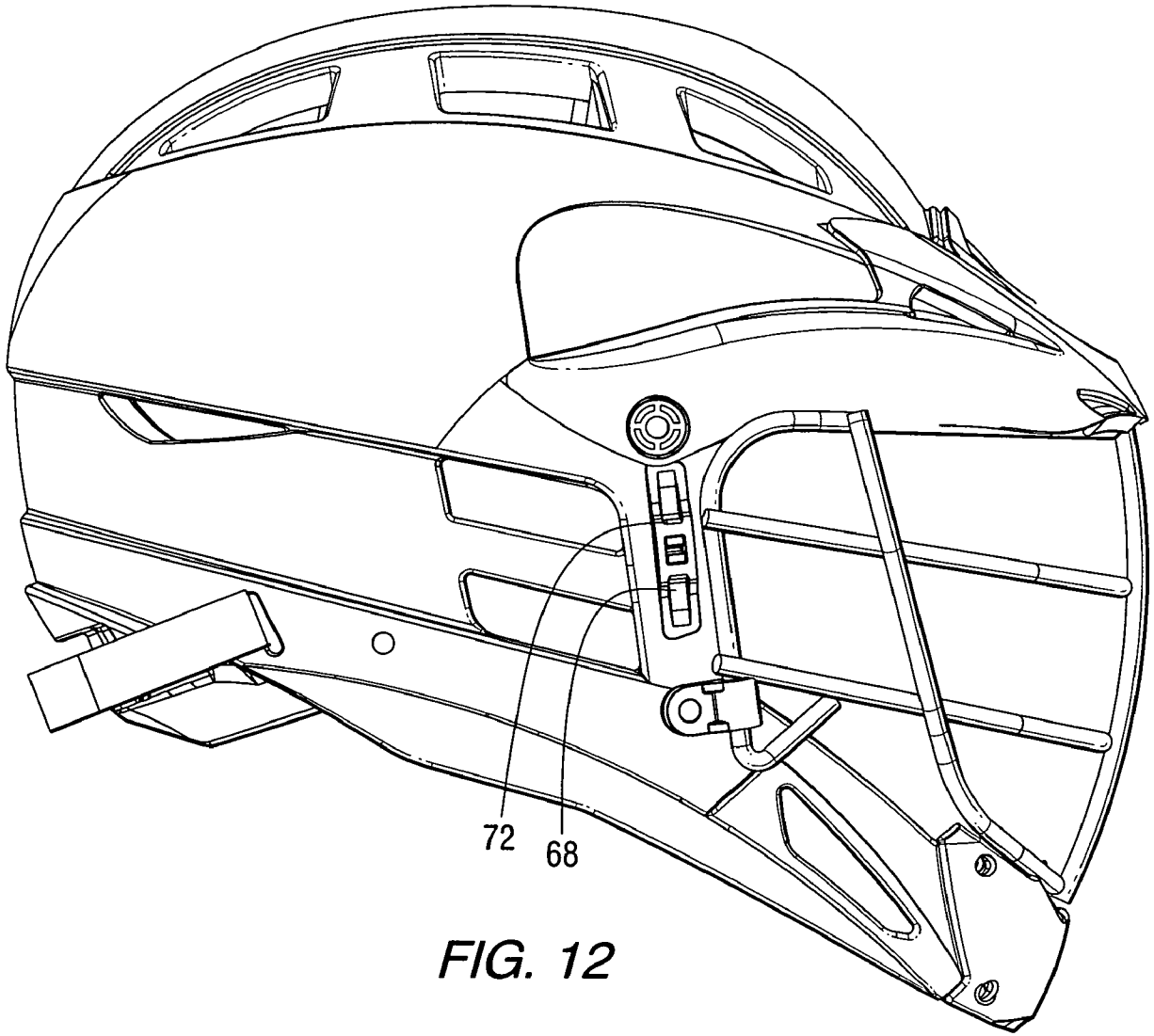
FIG. 12 is a side view of the protective helmet of FIG. 11 showing the slider in an upward position in which the side portion of the liner is in a wide position against the outer shell.
Figure 13:
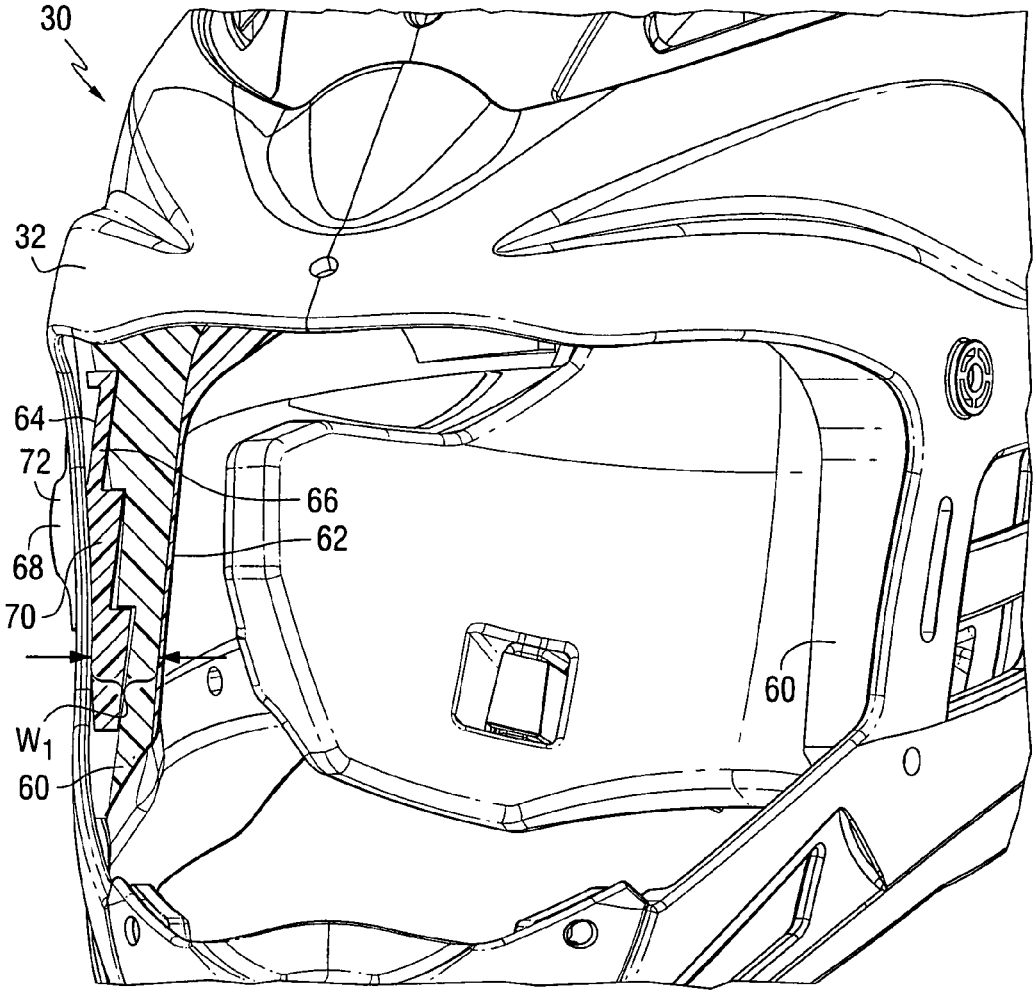
FIG. 13 is a front sectional view of a portion of the protective helmet of FIG. 12 showing the slider and side portion of the liner in the wide position.
Figure 14:
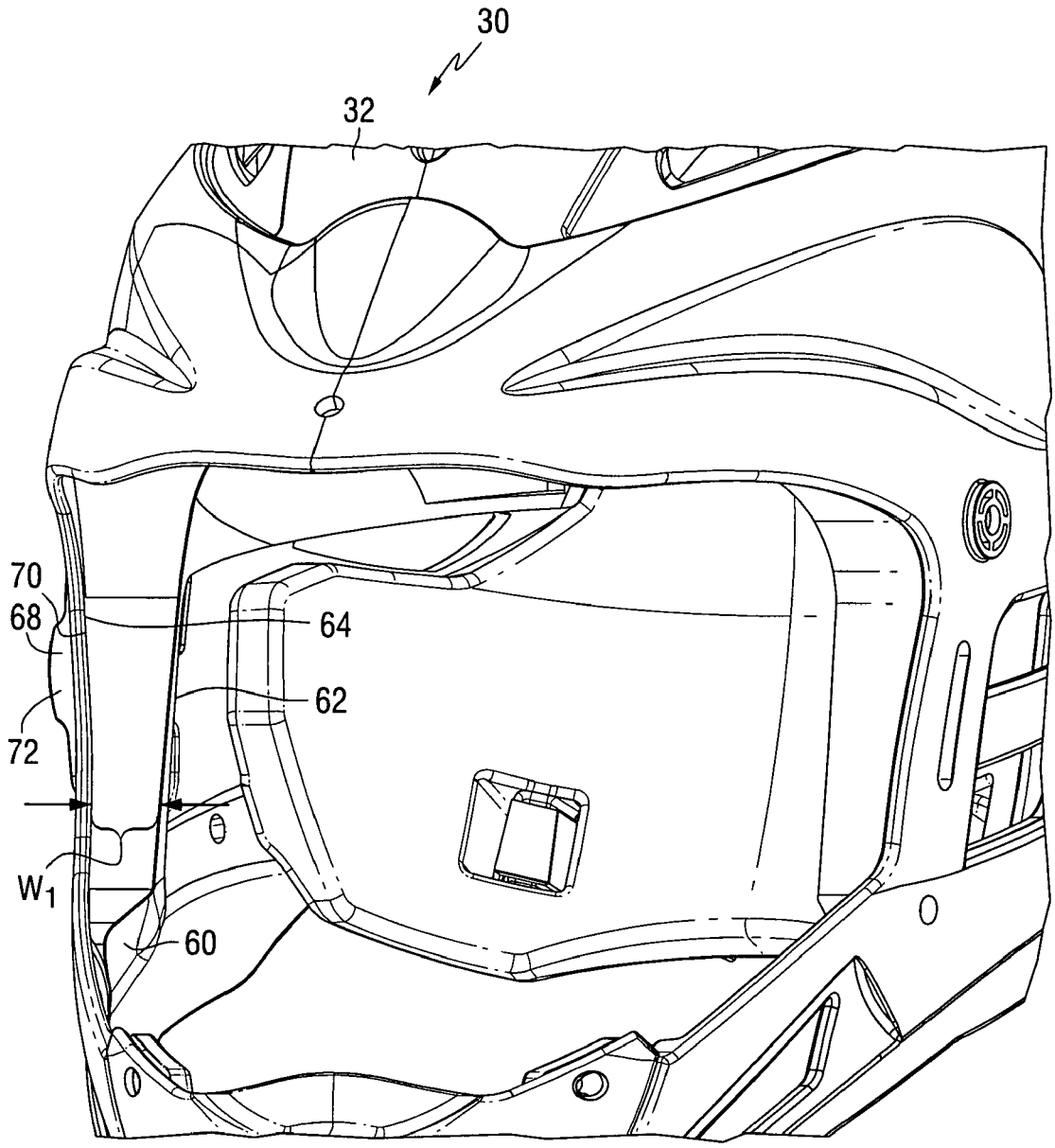
FIG. 14 is a frontal view of a portion of the protective helmet of FIGS. 12 and 13 showing the side portion of the liner against the outer shell.

It can also be desirable to adjustably secure a protective helmet against the head of a wearer in the lateral or side-to-side direction. As shown in FIGS. 11-16, the liner of the present invention can also comprise at least one side liner portion 60 adjustably securing the helmet 30 to the head of a wearer. Such adjustable side liner portions 60 are typically provided on both sides of the helmet 30, and are movable outwardly and inwardly with respect to the outer shell 32 in order to effectively widen and narrow the fit of the helmet 30. The side liner portion 60 can comprise a relatively smooth interior surface 62 for contacting the side of the face of a wearer, and a contoured exterior surface 64 comprising a plurality of ramped recesses 66 facing the inner surface of the outer shell 32. A slider 68 slidably mounted on the outer shell 32 of the helmet 30 comprises an interior side having a plurality of angled ramps or steps 70 and an exterior side having a manually engageable surface 72. When the slider 68 is in the unengaged or wide position, the steps 70 of the slider 68 align with the contours of the recesses 66 of the side liner portion 60 as shown in FIGS. 12-14 to provide a relatively wide fit. The unengaged wide position of the inner portion 60 is shown in FIGS. 13 and 14. When the slider 68 is moved by operating the manually engageable surface 72 from the unengaged wide position to the engaged narrow position, shown in FIGS. 15 and 16, the steps 70 of the slider 68 align against the contours of the recesses 66 of the side liner portion 60 to move the side liner portion 60 inwardly away from the outer shell in order to provide a relatively narrow fit.

Figure 15:
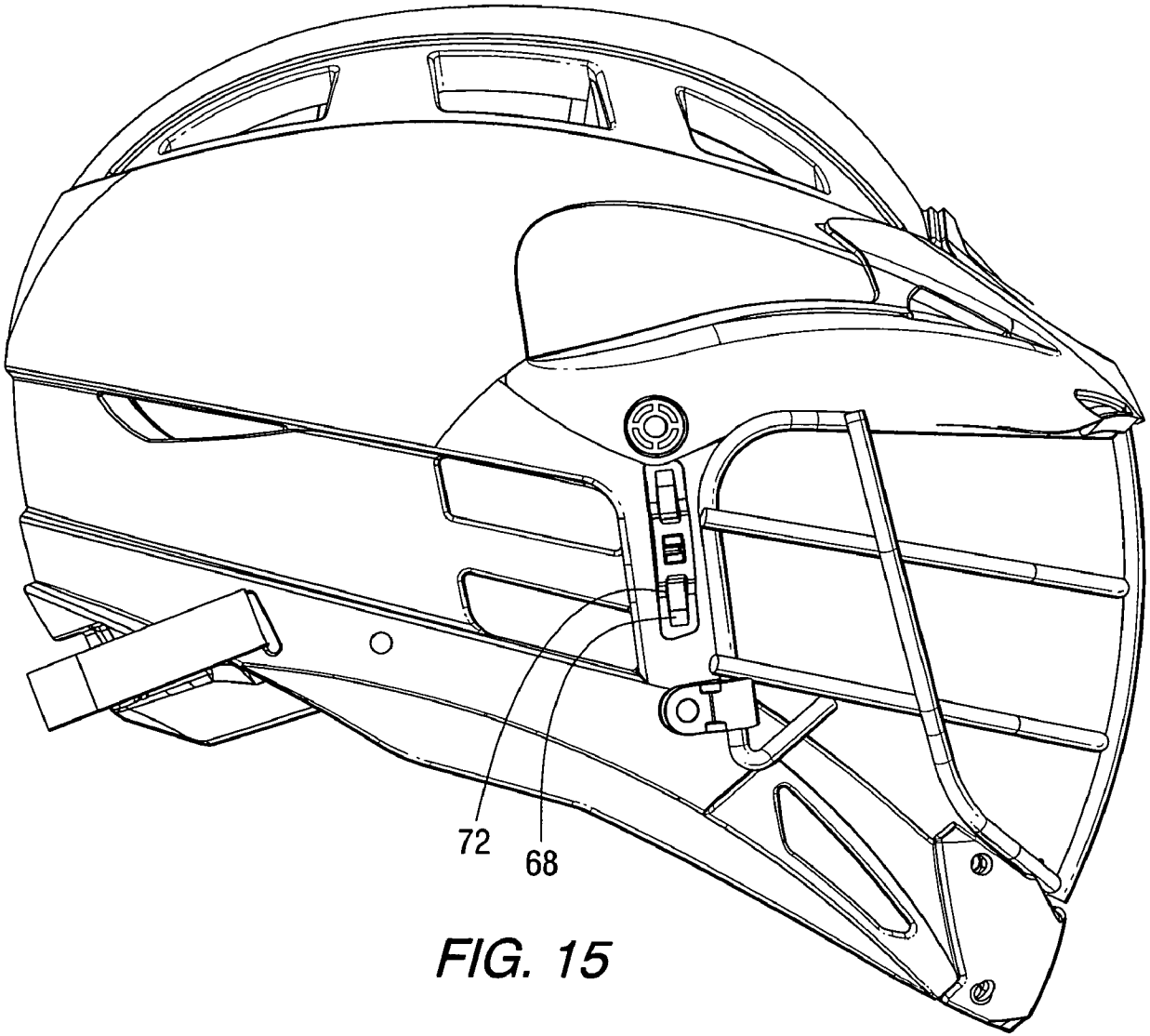
FIG. 15 is a side view of the protective helmet of FIG. 11 showing the slider in a downward position in which the side portion of the liner is moved to a narrow position away from the outer shell.
Figure 16:
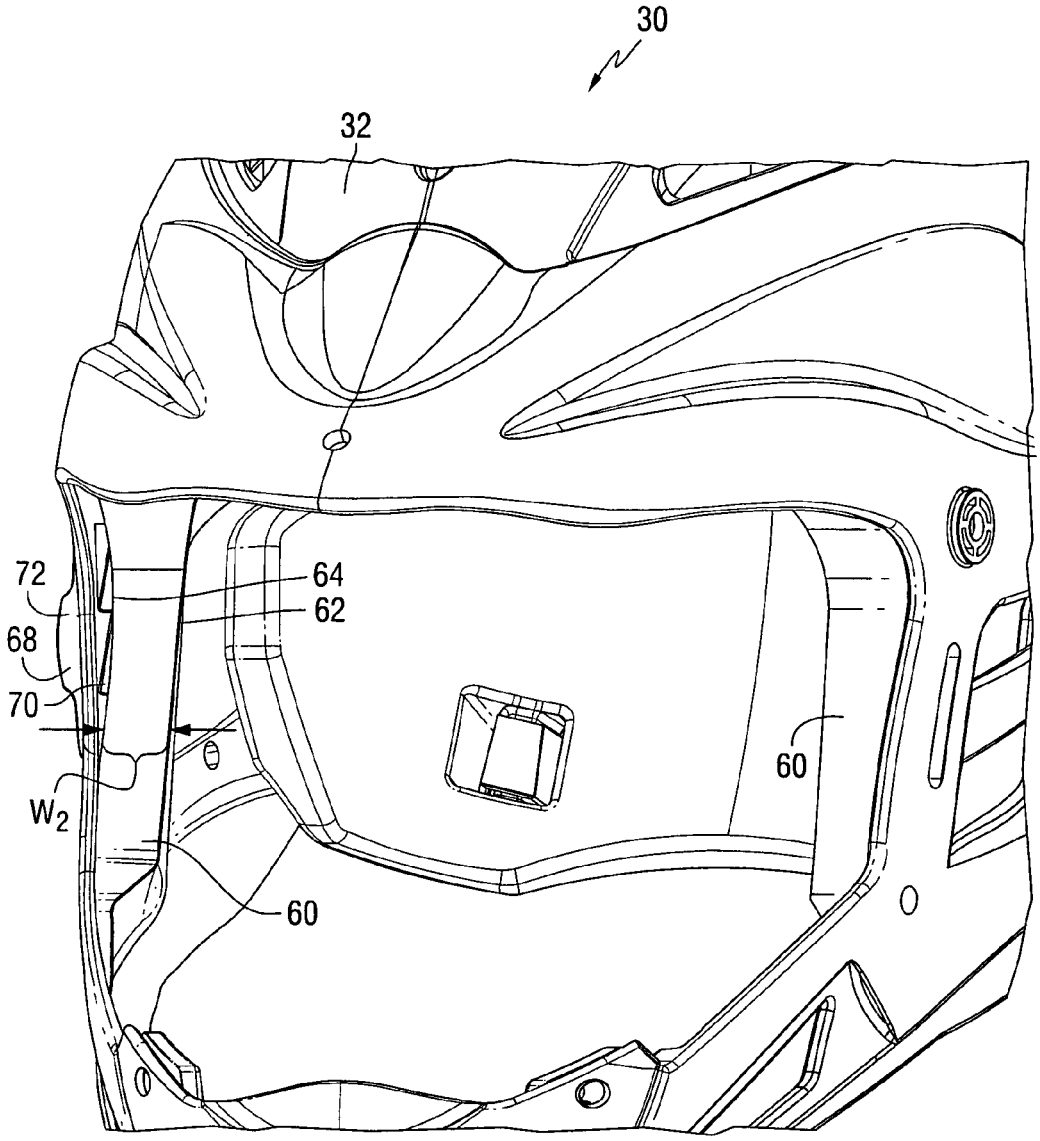
FIG. 16 is a frontal view of a portion of the protective helmet of FIG. 15 showing the side portion of the liner moved inwardly away from the outer shell.

As shown in FIGS. 12 and 15, the manually engageable surface 72 of slider 68 can be moved from a first position, shown in FIG. 12, to a second position, shown in FIG. 15, to effectuate the transition of the side liner portion 60 from the unengaged wide position to the engaged narrow position, and any intermediate positions therebetween. The width of the inner surface of the side liner portion 60 with respect to the outer shell 32 may be increased from the unengaged width $W_1$ shown in FIGS. 13 and 14 to the engaged width $W_2$ shown in FIG. 16. In one embodiment, $W_2$ can be from about 0.05 to about 0.5 inches greater than $W_1$. By increasing the width of the slider 68 and side liner portion 60 combination, the side-to-side fit of the liner can be adjusted to accommodate to the head of a wearer. It is contemplated herein, that a first slider can engage a first side liner portion 60 on the left side of the wearer's head and that a second slider can engage a second side liner portion 60 on the right side of the wearer's head.

Figure 17:
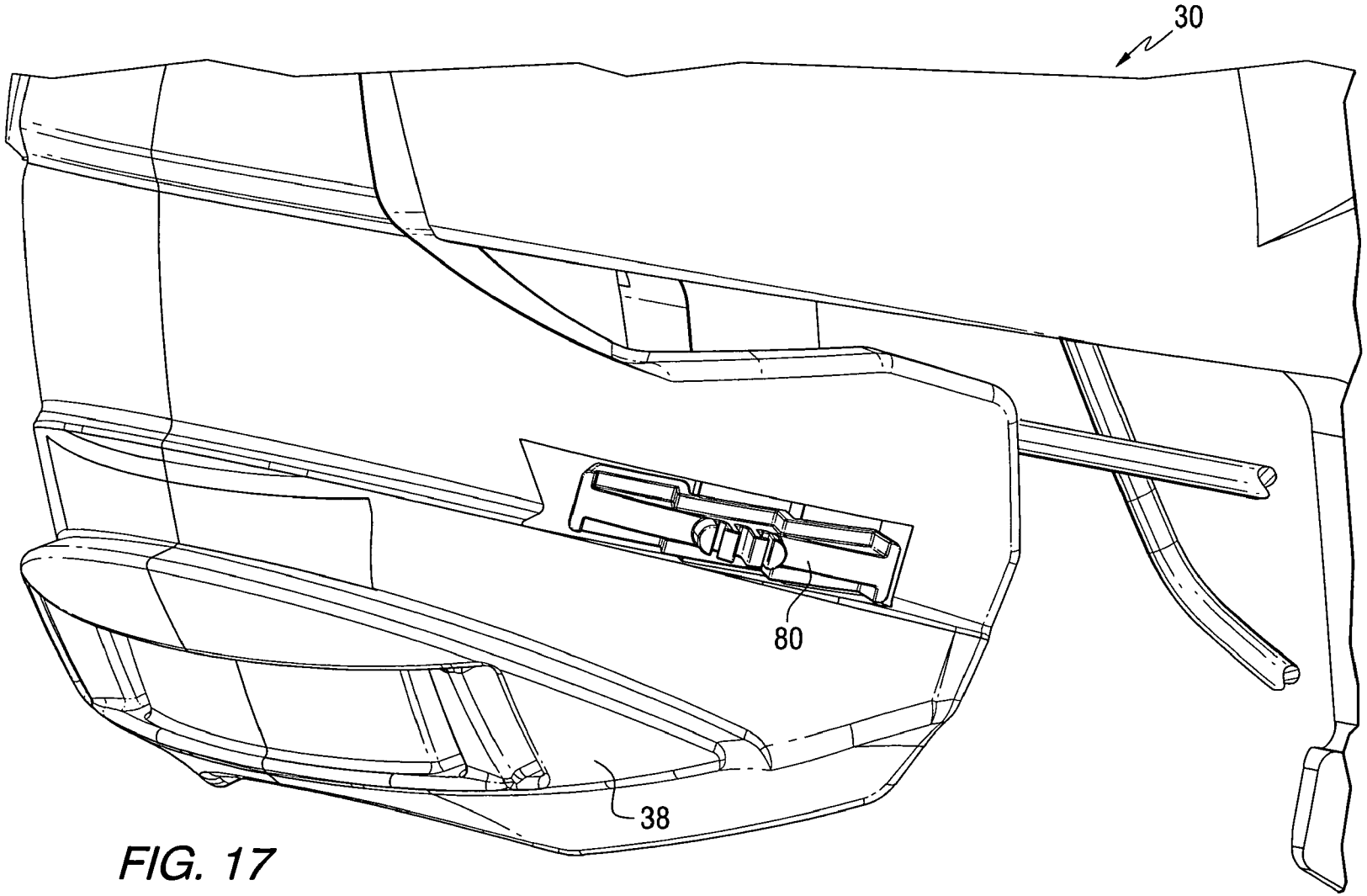
FIG. 17 is a rear side view of a portion of a protective helmet including a rear slider in an unengaged position in accordance with an embodiment of the present invention.
Figure 18:
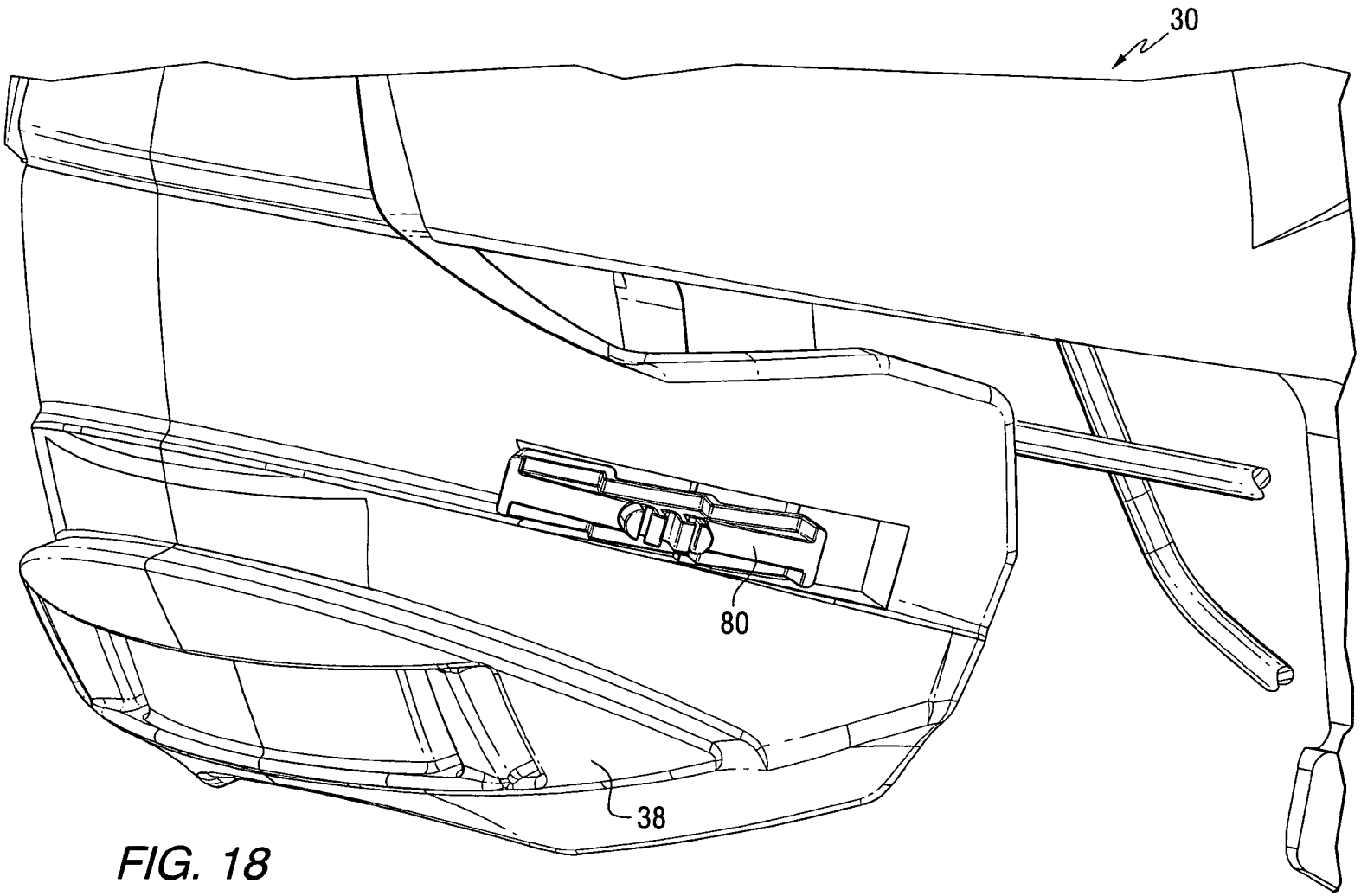
FIG. 18 is a rear side view of the portion of the protective helmet shown in FIG. 17 showing the rear slider moved to an engaged position.

As shown in the embodiment of FIGS. 17 and 18, a similar slider mechanism 80 can be used to adjust the fit of the anterior liner portion 38 discussed with respect to FIGS. 11-16. In this embodiment, the anterior liner portion 38 can comprise a relatively smooth interior surface for contacting the back of the head of the wearer, and a contoured exterior surface comprising a plurality of recesses. A slider 80 slidably mounted on a rear side portion of the outer shell 32 of the helmet 30 can comprise an interior side having a plurality of angled ramps or steps and an exterior side having a manually engageable surface. When the slider 80 is in the unengaged or wide position shown in FIG. 17, the steps of the slider 80 align with the contours of the recesses of the anterior liner portion. When the slider is moved from the unengaged position to the engaged position shown in FIG. 18, the steps of the slider 80 can align against the contours of the recesses of the anterior liner portion to move the anterior liner portion 38 inwardly away from the outer shell. The width of the slider 80 and anterior liner portion in the engaged position can be from about 0.25 to about 2 times the width of the slider 80 and anterior liner portion combination in the unengaged position.

Figure 19:
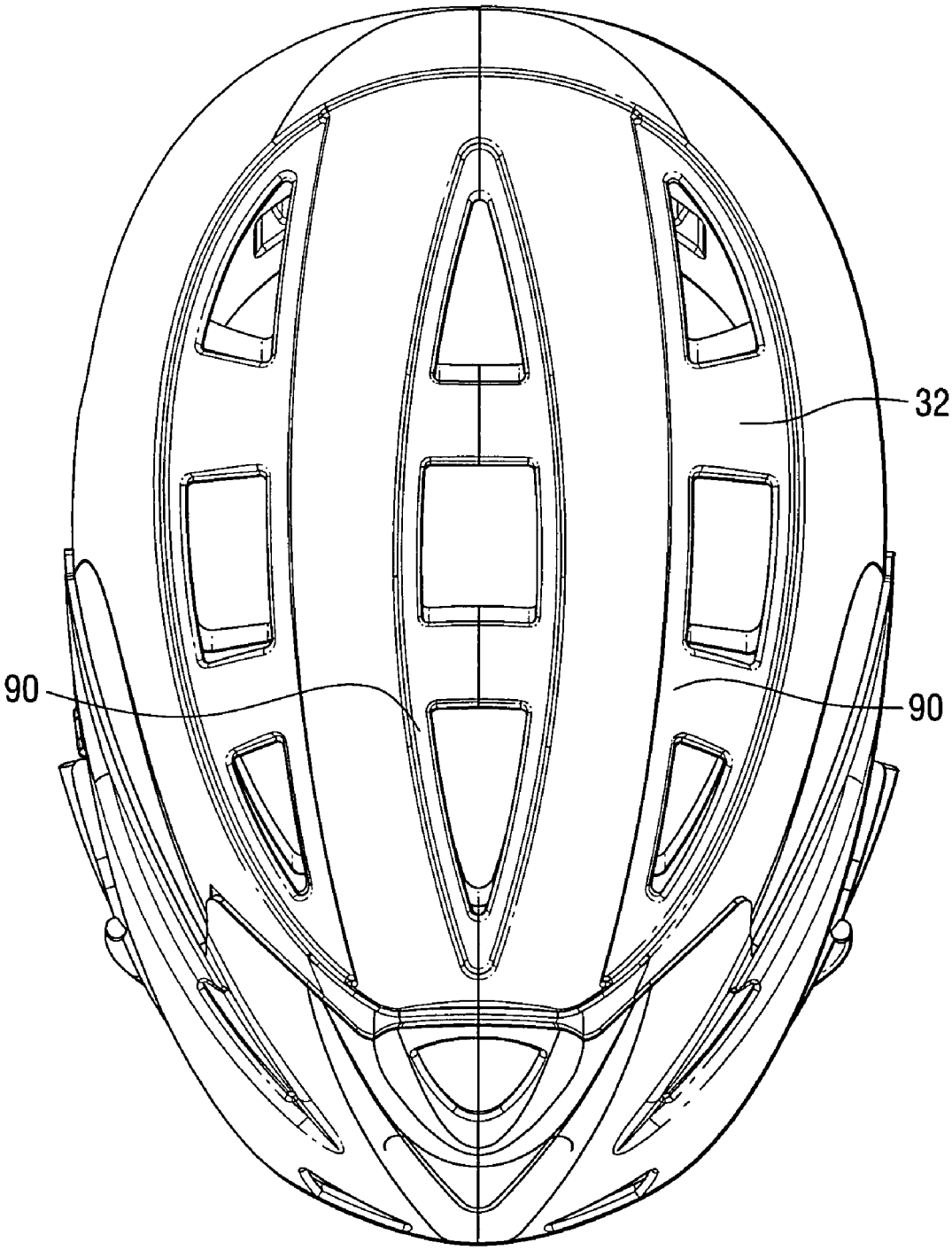
FIG. 19 is a top view of a protective helmet liner including longitudinally extending sections having liner grooves therein in accordance with an embodiment of the present invention.
Figure 20:
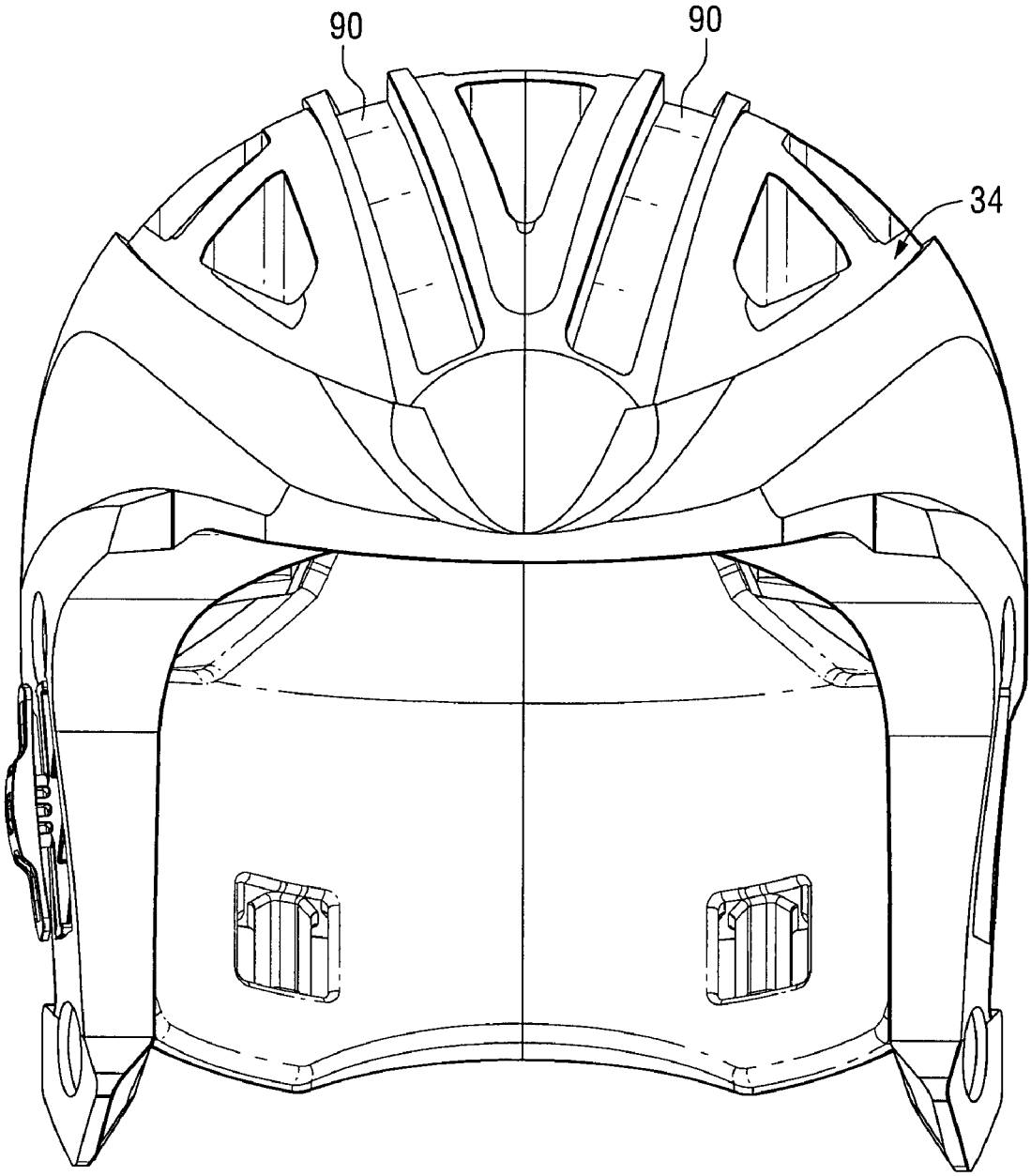
FIG. 20 is a front view of a protective helmet liner from the helmet of FIG. 19 including longitudinally extending grooves in accordance with an embodiment of the present invention.

In another embodiment, as shown in FIGS. 19 and 20, the top liner portion 40 can comprise a plurality of grooves 90 extending along a direction of the liner to dissipate at least some energy across the liner material upon impact. In one embodiment, the grooves 90 extend substantially along the entire length of the top liner portion 40 in the longitudinal direction. In another embodiment from about 2 to about 10 grooves can be disposed within the top liner portion 40 of the present invention. In another embodiment, the grooves can extend into the top liner portion 40 from about 2 mm to about 1.5 cm. In another embodiment, the grooves 90 can be substantially unfilled. In yet another embodiment, the grooves 90 can comprise a second foam material. The second foam material may have a different density and/or degree of compressibility.

Whereas particular embodiments of this invention have been described above for purposes of illustration, it will be evident to those skilled in the art that numerous variations of the details of the present invention may be made without departing from the invention.

What is claimed is:

1. A protective sport helmet comprising:

a protective outer shell; and helmet padding comprising:

a liner insert disposed within the protective outer shell, the liner insert comprising a padded top liner portion and at least one padded adjustable liner portion flexibly connected to the top portion in a flexible connection and movable from an expanded position adjacent to an inner surface of the protective outer shell to a contracted position away from the inner surface of the protective shell, said flexible connection comprising a first dovetail section on said padded top liner portion engaging a second dovetail section on said padded adjustable liner portion, said engaging dovetail sections permitting said padded adjustable liner portion to move with respect to said top liner portion.

2. The protective sport helmet of claim 1, wherein the at least one padded adjustable liner portion comprises an anterior liner portion located at a back of the helmet.

3. The protective sport helmet of claim 2, wherein the anterior liner portion is pivotally connected to the top liner portion.

4. The protective sport helmet of claim 2, further comprising a strap engaging the anterior liner portion and the protective outer shell, wherein the strap adjustably secures the position of the anterior liner portion with respect to the protective outer shell.

5. The protective sport helmet of claim 4, wherein the strap passes through the protective outer shell.

6. The protective sport helmet of claim 2, wherein the anterior liner portion comprises a resilient polymeric material.

7. The protective sport helmet of claim 2, wherein the anterior liner portion comprises foam material.

8. The protective sport helmet of claim 1, further including a side liner portion located at a side of the helmet.

9. The protective sport helmet of claim 8, further comprising a slide member slidably mounted on a side of the protective outer shell, wherein movement of the slide member adjusts the position of the side liner portion with respect to the protective outer shell.

10. The protective sport helmet of claim 8, wherein the side liner portion comprises a resilient polymeric material.

11. A protective sport helmet comprising:

a protective outer shell; and a liner insert disposed within the protective outer shell, the liner insert comprising a top liner portion and an anterior liner portion flexibly connected to the top portion and movable from a first position adjacent to an inner surface of the protective outer shell to a second position away from the inner surface of the protective shell, the anterior liner portion being pivotally connected to the top liner portion, wherein the top liner portion comprises a first dovetail section and the anterior liner portion comprises a second dovetail section pivotally mounted on and engaging the first dovetail section.

12. The protective sport helmet of claim 11, further comprising a strap engaging the anterior liner portion and the protective outer shell, wherein the strap adjustably secures the position of the anterior liner portion with respect to the protective outer shell.

13. The protective sport helmet of claim 12, wherein the strap passes through the protective outer shell.

14. The protective sport helmet of claim 11, wherein the anterior liner portion comprises a resilient polymeric material.

* * * * *